United States Patent [19]

Riordan

[11] Patent Number: 4,475,506

[45] Date of Patent: Oct. 9, 1984

[54] PROGRAMMABLE FUEL ECONOMY OPTIMIZER FOR AN INTERNAL COMBUSTION ENGINE

[75] Inventor: Hugh E. Riordan, West Bend, Wis.

[73] Assignee: Brunswick Corporation, Skokie, Ill.

[21] Appl. No.: 573,579

[22] Filed: Jan. 25, 1984

Related U.S. Application Data

[63] Continuation of Ser. No. 305,900, Sep. 25, 1981, abandoned.

[51] Int. Cl.[3] ..... F02D 31/00

[52] U.S. Cl. ..... 123/352; 123/436

[58] Field of Search ..... 123/436, 350, 352, 353, 123/354

[56] References Cited

U.S. PATENT DOCUMENTS

| | | | |
|---|---|---|---|
| 2,628,606 | 2/1953 | Draper et al. | 123/352 |
| 2,842,108 | 7/1958 | Sanders | 123/352 |
| 4,026,251 | 5/1977 | Schweitzer et al. | 123/436 |
| 4,044,234 | 8/1977 | Fiobenius et al. | 123/436 |
| 4,064,846 | 12/1977 | Latsch et al. | 123/436 |
| 4,242,995 | 1/1981 | Schramm et al. | 123/352 |
| 4,368,707 | 1/1983 | Leshner et al. | 123/436 |

OTHER PUBLICATIONS

"An Extreme Searching Controller for Mixture Strength Optimization on an Internal Combustion Engine" by M. Garrignes et al., 4th European Conference on Electronics, pp. 591–595, Mar. 24–28, 1980.

*Primary Examiner*—Parshotam S. Lall

*Attorney, Agent, or Firm*—Hopgood, Calimafde, Kalil, Blaustein & Judlowe

[57] ABSTRACT

A self-adaptive fuel control system for an internal combustion engine which provides maximum fuel economy over all conditions of engine operation. Maximum fuel economy is provided by maintaining engine operation at a preselected point on the r.p.m. vs. fuel flow curve, said preselected point being near the border line of lean misfire but at a displacement from the point of misfire sufficient to provide smooth running.

6 Claims, 3 Drawing Figures

PROGRAMMABLE FUEL ECONOMY OPTIMIZER FOR AN INTERNAL COMBUSTION ENGINE

This is a continuation of copending application Ser. No. 305,900, filed Sept. 25, 1981, now abandoned.

FIELD OF THE INVENTION

This invention relates to fuel control systems for internal combustion engines and more particularly to a self-adaptive fuel control system which provides maximum fuel economy for any given throttle position on an internal combustion engine.

BACKGROUND OF THE INVENTION

Maximum fuel economy is now the primary goal for designers of internal combustion engines in view of the current and ever increasing cost of gasoline.

The customary practice in designing and calibrating the fuel supply systems for internal combustion engines is to pre-schedule fuel flow according to some function of engine operating condition as measured on the engine during operation. On carburetor type engines the principal measured function is usually venturi pressure, and the fuel flow is primarily determined by this pressure (or depression) and secondarily the fuel flow may be determined by measuring various engine functions such as r.p.m., manifold vacuum, air flows, throttle position, etc., and controlling the fuel flow in accordance with some predetermined schedule.

Fuel control systems of the type described above depend on prior knowledge of how the engine will perform under all possible conditions of load and environment. Such systems, even when relatively complicated and expensive, only obtain optimum performance in terms of fuel economy under a limited set of operating conditions.

It is therefore a general object of the present invention to provide a self-adaptive fuel control system that does not depend on prior knowledge of engine performance.

Self adaptive fuel control systems per se are known and have been discussed by Draper and Li in U.S. Pat. No. 2,628,606. However, the Draper and Li system is designed to provide peak power output (maximum r.p.m.) for any given throttle setting and does not provide maximum fuel economy, as maximum fuel economy occurs near the borderline of lean misfire, not at maximum r.p.m.

It is therefore a further object of the present invention to provide a self-adaptive fuel control system that will provide maximum fuel economy for any given throttle setting.

SUMMARY OF THE INVENTION

In accordance with the invention an internal combustion engine is operated at a preselected point on the r.p.m. vs. fuel flow curve, said preselected operating point providing maximum fuel economy during engine operation when maintained near the borderline of lean misfire but at a displacement from the point of misfire sufficient to provide smooth running.

It is a feature of the invention that engine operation is maintained at or near the preselected operating point by periodically increasing or decreasing the fuel flow at a constant rate, measuring the resultant change in engine r.p.m. and utilizing the magnitude and direction of the change in engine r.p.m. to determine whether to subsequently increase or decrease the fuel flow rate.

It is another feature of the invention that fuel flow is increased or decreased for a predetermined sampling period, change in engine r.p.m. is measured over the interval of the sampling period and fuel flow is either increased or decreased during a subsequent sampling period to maintain engine operation at or near the preselected operating point.

The foregoing and other objects and features of this invention will be more fully understood from the following description of an illustrative embodiment thereof taken in conjunction with the accompanying drawings.

DETAILED DESCRIPTION

Figure 1:
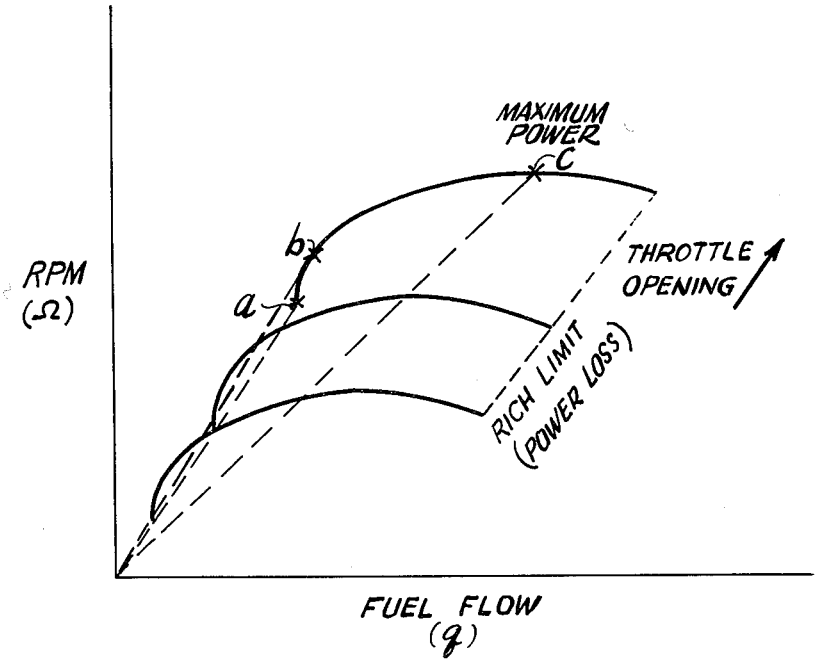
FIG. 1 illustrates a typical r.p.m. vs. fuel flow curve for an internal combustion engine.

FIG. 1 shows a typical rpm vs. fuel flow curve for various settings of engine throttle opening. Points a, b and c on the top curve illustrate respectively the conditions of over lean fuel flow, maximum fuel economy and maximum power. To the far right of each curve is the condition of fuel rich limit with resultant power loss.

It is known that for a given engine, operating with continuously connected load, the rpm vs. fuel flow curves will exhibit a relatively constant shape on the lean side of the curves for any given throttle setting. The fuel control system of the instant invention takes advantage of this phenomenon and maintains the fuel delivery rate consistently near the lean limit while avoiding misfire. That is, the fuel control system seeks to operate the associated internal combustion engine at or near point b on the rpm vs. fuel flow curve where the slope of the curve is always positive but the displacement from the lean limit and misfire is sufficient to provide smooth running.

Figure 2:
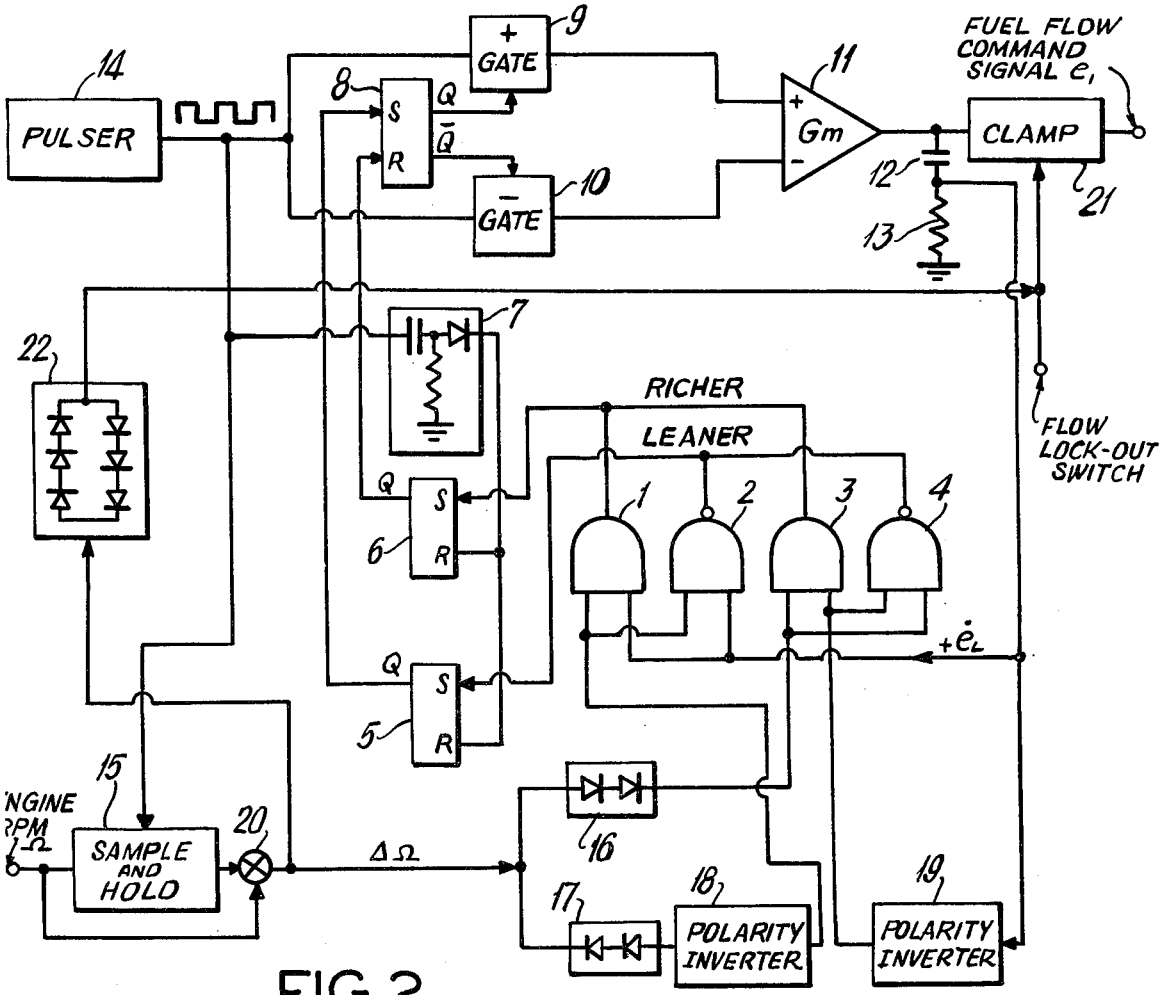
FIG. 2 shows a first embodiment of the invention for maintaining engine operation at a preselected point on the curve of FIG. 1.

A first embodiment of the invention is shown in FIG. 2. In general such a fuel control system belongs to the class of self-adaptive systems which uses a test disturbance to sense the operating point of the controlled process. The three variables of interest in sensing engine operating point are the engine r.p.m., throttle setting and fuel flow rate. Throttle opening and fuel flow are assumed to be independently controllable.

The necessary information on engine operating point is obtained by making a known small change in the fuel flow to the engine and observing the resultant change in engine r.p.m. while allowing the throttle position to remain relatively constant. This process is performed repeatedly and the average fuel flow adjusted until the engine is operating in the desired region on the r.p.m. vs. fuel flow curve.

In the embodiment shown in FIG. 2, the controller objective, in order to achieve maximum fuel economy, is to operate the engine at or near point b on the rpm vs. fuel flow curve. To accomplish this objective it is necessary to select a value of positive slope, $\Delta\Omega/\Delta q$ that falls at or near point b, and then use this as a reference against which to compare the actual slope during engine operation and make the necessary alterations in fuel flow. That is, the controller measures the slope of r.p.m. vs. fuel flow characteristic, compares it with the predetermined reference slope and makes the appropriate adjustment in fuel flow.

One way to achieve the foregoing measurement and comparison process is to periodically increase or decrease the fuel flow at a constant rate, for a fixed sampling period, measure the resultant change in r.p.m., relative to a fixed reference value of r.p.m. change determined from the engine calibration data, and use the resulting error signal to determine whether to increase or decrease the fuel flow during the next sampling period.

The foregoing can be simply implemented by way of the following algorithm:

A. Decreasing Fuel Flow:
1. Decrease fuel flow at a constant rate qo for a fixed time to,
2. If engine r.p.m. decreases by more than a predetermined reference amount X, then during the next sampling period increase the fuel flow at rate qo,
3. If the engine r.p.m. increases by any amount under condition 1 then decrease the fuel flow at rate qo during the next sampling period,
4. If there is no decrease in r.p.m. greater than X, then decrease the fuel flow at rate qo, during the next sampling period.

B. Increasing Fuel Flow:
1. Increase fuel flow at rate qo for time to,
2. If engine r.p.m. increases by more then the reference amount X than increase the fuel flow at rate qo during the next sampling period,
3. If engine r.p.m. does not change by more than X than decrease the fuel flow at rate qo.

While various circuit configurations can be devised to implement the foregoing control algorithm, a preferred embodiment is shown in FIG. 2. Pulser 14 is a square wave generator which determines sampling frequency and sample duration. The output of pulser 14, shown in FIG. 2, is a fixed amplitude constant repetition rate square wave with a preferable duty cycle of approximately 80%. The sampling period for the control circuit is defined as the duration of each positive pulse in the square wave generated by pulser 14. This waveform is applied to gates 9 and 10 and from there to the inputs of a differential transconductance amplifier 11. Gates 9 and 10 are controlled by flip-flop 8 in a manner to be described below.

The output signal from amplifer 11 is a fixed amplitude current square wave. This square wave is positive (amplitude greater than zero) when a pulse is applied to the "+" input of amplifier 11 and negative (amplitude less than zero) when a pulse is applied to the "−" input of amplifier 11. The square wave output of amplifier 11 is applied to capacitor 12 to produce an ascending or descending ramp voltage which is applied, through clamp 21, to a fuel flow controlling device (not shown) which may be either an injection system or a carbuertor with electrically controllable metering. An ascending ramp voltage is used to decrease the flow rate while a descending ramp voltage is used to increase the fuel flow rate. A voltage signal is developed across sensing resistor 13 which provides synchronizing information and the sign of the rate of change of the fuel flow control signal in a manner to be described below.

Assume now that the control system in FIG. 2 is in a period of decreasing fuel flow, i.e. part A of the foregoing algorithm is being implemented. In this state, gate 9 is enabled by flip-flop 8 (the Q output is equal to a logical "1") and the output of amplifier 11, in conjunction with capacitor 12, is producing the positivity increasing ramp signal, identified in FIG. 2 as the fuel flow command signal $e_f$.

Each positive pulse generated by pulser 14 places sample and hold circuit 15 in the hold mode. Thus, at the beginning of each sampling period (leading edge of the pulse from pulser 14) a reference value of the engine r.p.m. is stored in sample and hold circuit 15 and applied to comparator 20. The reference value, for the embodiment shown in FIG. 2, is equal to actual engine r.p.m. at the beginning of the sampling period. Comparator 20 compares the stored value of engine r.p.m. with the instantaneous value of engine r.p.m. occurring during the sampling period and generates an error signal ($\Delta\Omega$), representing the change in r.p.m. during the sampling period. The $\Delta\Omega$ signal is applied to threshold circuits 16 and 17. The threshold circuits, as indicated, are simply series diodes which will pass a voltage signal of proper polarity and of a voltage magnitude sufficient to forward bias the two series diodes.

If $\Delta\Omega$ is negative (decreasing r.p.m.), and of a magnitude sufficient to forward bias the two series diodes, the negative $\Delta\Omega$ signal will be passed through threshold circuit 17 and inverted by polarity inverter 18. The inverted $\Delta\Omega$ signal, now of a positive polarity, is applied to one input of AND gate 1. The fuel flow command signal $e_f$ is applied to the remaining input of AND gate 1.

The fuel flow command signal is at this time positive as the control circuit is in the decreasing fuel flow mode, and therefore AND gate 1 is enabled. The output of AND gate 1 places flip-flop 6 in the SET state which in turn places flip-flop 8 in the RESET state, disabling gate 9 and enabling gate 10. The output of pulser 14 is accordingly directed to the "−" input of amplifier 11 which serves to generate a decreasing fuel flow command signal to increase the fuel flow rate. Upon the occurrance of the next clock pulse from pulser 14, pulse shaping network 7 produces a pulse that resets flip-flop 6, thereby leaving flip-flop 8 in the mode previously set by AND gate 1. This, of course, ensures that the fuel flow rate will be increased during the next sampling period, thereby fulfilling step A2 of the algorithm set forth above.

Turning now to step A3 of the foregoing algorithm, we assume a decreasing fuel flow condition and an increasing engine r.p.m. In this circumstance $\Delta\Omega$ will be positive and will be passed through thereshold circuit 16 and applied to one input of AND gate 3 and one input of NAND gate 4. The fuel flow command signal $e_f$ is at this time positive because the control circuit is in a decreasing fuel flow condition. The positive fuel flow command signal, inverted by polarity inverter 19, applys a logical "0" signal to one input of AND gate 3, disabling this gate, and a logical "0" signal to one input of NAND gate 4. The output of NAND gate 4 therefore becomes a logical "1" level, placing flip-flop 5 in the SET state, which in turn places flip-flop 8 in the SET state, enabling gate 9. The output of pulser 14 is accordingly applied to the "+" input of amplifier 11, which, in response thereto, continues the generation of a positively increasing fuel flow command signal, thereby decreasing the fuel flow rate. The next pulse from pulser 14 generates a RESET signal through pulse shaping network 7, flip-flops 6 and 7 are RESET and flip-flop 8 remains in its previous state for the next sampling period. The foregoing fulfills step A3 of the algorithm set forth above.

Step A4 of the algorithm considers the condition when there is no decrease in engine r.p.m. greater than the reference amount X during the sampling period. In this state $\Delta\Omega$ will be negative but not sufficiently negative to overcome the forward bias of threshold circuit 17. Therefore a logical "0" signal will be generated by polarity invertor 18 and NAND gate 2 will be enabled by this signal in conjunction with the positive fuel flow command signal $e_l$ (decreasing fuel flow condition). This calls for another decrease in fuel flow during the next sampling period through flip-flops 5 and 8, and gate 9 in the manner previously described.

The increasing fuel flow condition is governed by part B of the algorithm. With increasing fuel flow, gate 10 is enabled, the output of pulser 14 is applied to the "−" input of amplifier 11 and a negatively decreasing fuel flow command signal is generated. Referring to step B2 of the algorithm, if engine r.p.m. increases by more than the reference amount X, $\Delta\Omega$ is positive and threshold circuit 16 is enabled. This applies a logical "1" level to one input of AND gate 3. The other input of AND gate 3 is also at a logical "1" level because the negative fuel flow command signal has been inverted by polarity inverter 19. The logical "1" output of gate 3 places flip-flop 6 in the SET state, which in turn places flip-flop 8 in the RESET state, enabling gate 10 and disabling gate 9. In accordance with the discussion above the fuel flow thereby continues to increase during the next sampling period, complying with the requirements of step B2 of the algorithm.

Step B3 of the algorithm defines the condition where the engine r.p.m. does not change by more than the reference amount X during the sampling period. In this state $\Delta\Omega$ is not sufficient to overcome the threshold level of circuits 16 and 17, and therefore, the output of threshold circuit 16 is at a logical "0" level and the output of threshold circuit 17 is at a logical "1" level. This condition, in conjunction with a negative fuel flow command signal, enables NAND gate 2 and fuel flow is decreased during the next sampling period in the manner previously described.

The procedure just described, for implementing the steps of the algoithm set forth above, results in a fuel flow rate that will cycle through a range corresponding to an r.p.m. change of approximately 2 X, about a mean value removed from the lean limit by an amount corresponding to a r.p.m. change of approximately X. This operation will continue when the change in engine speed drive, from variations in throttle setting or load, occurs at a rate which is small compared with the rate of change resulting from the programmed rate of change in fuel flow. To avoid serious off-range operation of the engine during acceleration and deceleration, a lock-out circuit is required to disable the optimization function.

Lock-out is effected by means of dual limiter 22 and clamp 21. More particularly, whenever the r.p.m. changes by an amount greater than 2X, during a single sampling period, dual limiter 22 is enabled which in turn enables clamp circuit 21. This serves to clamp the fuel flow command signal at a value corresponding to nominal fuel mixture conditions. Normal fuel regulating functions, described above, then assume command of mixture control. In order to provide maximum power for wide open throttle operation, a lockout switch (not shown) is provided on the throttle control that actuates clamp 21 when the throttle is placed in a wide open state.

The sampling duration for the circuit in FIG. 2 must be long enough to provide a useful r.p.m. change signal in the presence of noise and the magnitude of the fuel flow change must be large enough to provide a significant change in r.p.m. Also, the sampling frequency must be high enough to permit reasonably rapid stabilization of operation about the desired operating point. These requirements can be satisfied with a preferred sampling rate of from two to five samples per second and a threshold value of change in r.p.m. corresponding to 10 to 20 r.p.m.

The embodiment of the invention illustrated in FIG. 2 achieves maximum fuel economy over the entire range of engine operating conditions by using a fixed reference value of r.p.m. change and fuel flow rate change. The reference value of r.p.m. change is set by the threshold level of threshold circuits 16 and 17, while the fuel flow rate change is determined by the fixed duration of the sampling period and the fixed slope of the increasing or decreasing fuel flow command signal. Preselecting these reference values places the engine operating region near the lean operating limit of the engine and the embodiment of FIG. 2, then self adjusts to provide good fuel economy over all operating conditions.

Figure 3:
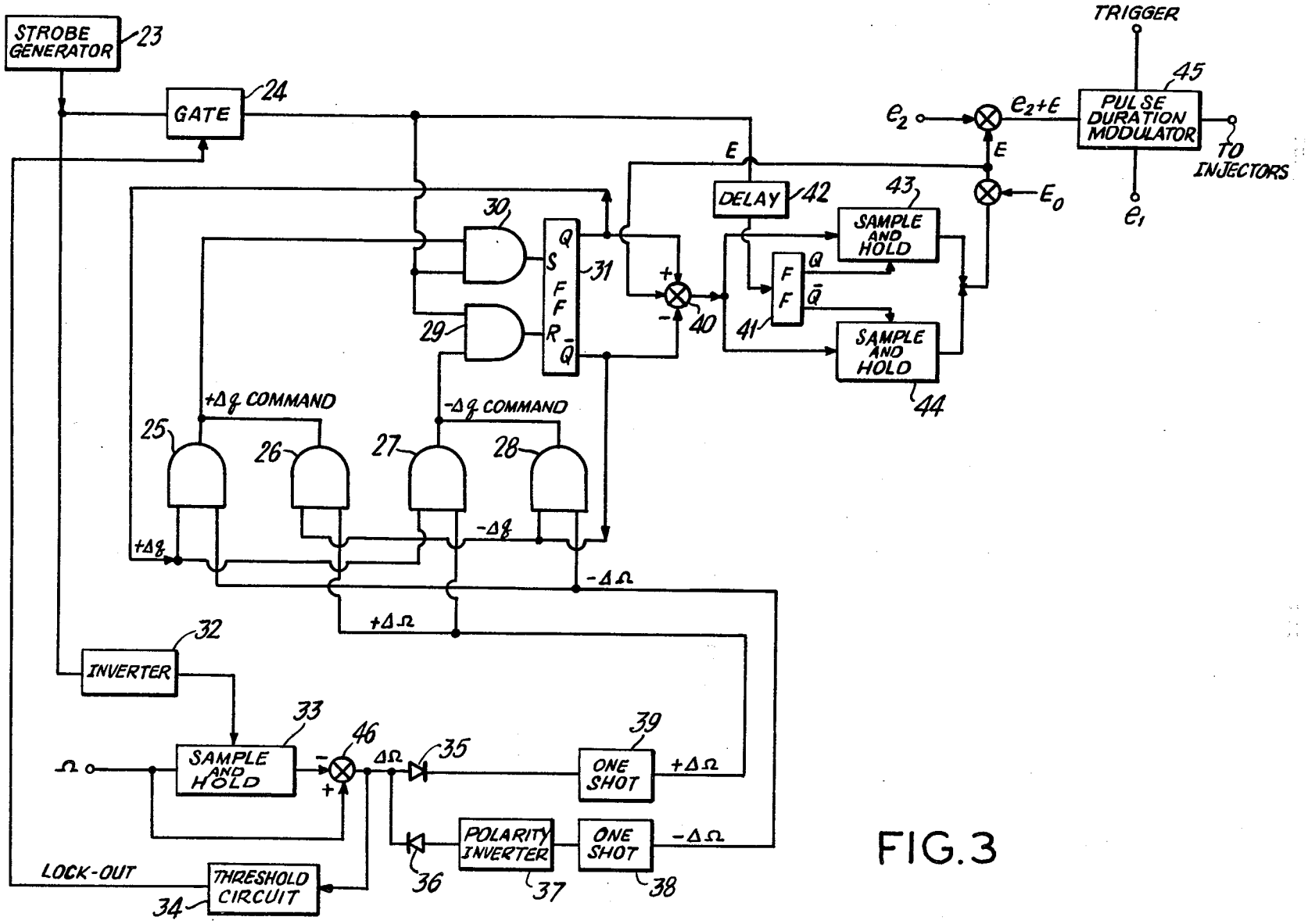
FIG. 3 shows a second embodiment of the invention for maintaining engine operation at the preselected point on the curve of FIG. 1.

The embodiment of FIG. 3 also provides maximum fuel economy for all engine operating conditions but does so without requiring a preselected reference value for the fuel flow rate or the change in engine r.p.m. More particularly, as described above, FIG. 1 illustrates a typical set of r.p.m. vs. fuel flow curves for an engine operating with a stable connected load. If one assumes that engine speed (r.p.m.) is reasonably representative of vehicle speed, then maximum economy, in terms of distance travelled for a given quantity of fuel burned, is obtained when the ratio of engine r.p.m. to fuel flow is a maximum. This ratio can be represented by the angle of the radius vector from the origin of the graph in FIG. 1 to any point on a given throttle setting curve. It is evident from FIG. 1 that the angle of the radius vector, and hence the economy, is a maximum at the point where the radius vector is tangent to the curve, or, point b in FIG. 1. The mathematical description of this optimum point simply defines the condition where the slope of the curve equals the slope of the radius vector, or:

$$\Omega/q = d\Omega/dq \qquad (1)$$

The embodiment of the invention shown in FIG. 3 adjusts the fuel flow so that equation 1 is satisfied under all conditions of operation and does so without the need of pre-selecting a reference value of change in engine r.p.m. or change in the fuel flow rate.

In order to measure the functions required for the evaluation of equation 1, it is necessary for there to be present in the system a disturbance of $\Omega$ and q that enables the evaluation of the derivative $d\Omega/dq$ or its finite approximation $\Omega\Delta/\Omega q$. As with the embodiment of FIG. 2 this is most easily effected by systematically varying q, and observing the resulting change in $\Omega$. The quantities of engine r.p.m. ($\Omega$) and fuel flow rate (q) can be measured directly or obtained by scaling from measurement of related quantities. It is convenient to form $d\Omega/dq$ from observation of the time derivative since:

$$\frac{d\Omega}{dq} = \frac{\frac{d\Omega}{dt}}{\frac{dq}{dt}} \quad (2)$$

Based on FIG. 1 and Equation 1, the following control algorithm can be formulated:

A. If $d\Omega/dq > \Omega/q$, the mixture is too lean and q should be increased.

B. If $d\Omega/dq < \Omega/q$ the mixture is too rich and q should be decreased.

The embodiment in FIG. 3 implements the above algorithm for use with a pulse duration modulated fuel injection system of the type described in co-pending patent application Ser. No. 120,467. In said co-pending application one or more square wave pulse generators drive solenoid-operated fuel injectors unique to each engine cylinder. The engine control system modulates the pulse generator means as necessary to accommodate throttle demands in the context of engine speed and other factors. Although the embodiment of FIG. 3 is illustrated for use with a fuel injected internal combustion engine the system with minor modifications may also be used with a carburetor system having electrically controllable metering as illustrated in conjunction with the embodiment of the invention shown in FIG. 2. The modifications necessary to adapt the embodiment of FIG. 3 to a carburetor system are not illustrated herein as such modifications would be apparent to one skilled in this technical area.

Assume now that with the embodiment of FIG. 3 fuel is supplied under substantially constant pressure to a valves or values that are opened by a control pulse having a repetition frequency proportional to r.p.m. and a duration during each engine r.p.m. cycle which is controlled according to the desired fuel flow. The equation for such a fuel delivery system is:

$$q = qoK_\Omega \Omega t_i \quad (3)$$

where:

q = fuel flow (average)

qo = fuel flow when value is open $t_i$ = duration of open pulse $K_\Omega$ = number of delivery pulses per engine revolution $\Omega$ = engine speed in r.p.m.

Using, as a disturbance, periodic finite changes in pulse duration, equation 3 becomes:

$$\Delta q = qoK_\Omega(\bar{\Omega}\Delta\bar{t}_i + t_i\Delta\Omega) \quad (4)$$

where:

$\Omega$ = average engine speed over a number of pulse periods $\bar{t}_i$ = average pulse duration $\Delta t_i$ = change in pulse duration (disturbance)

$\Delta\Omega$ = change in r.p.m. resulting from the change in pulse duration.

The inequalities of the fuel flow control algorithm for the embodiment of FIG. 3 can than be written as:

$$\frac{\Delta\Omega}{\Delta q} = \frac{\Delta\Omega}{qoK_\Omega(\bar{\Omega}\Delta t_i + t_i\Delta\Omega)} > \frac{\bar{\Omega}}{qoK_\Omega \bar{t}_i\bar{\Omega}} \rightarrow \text{Go Rich} \quad (5)$$

-continued $$\frac{\Delta\Omega}{\Delta q} = \frac{\Delta\Omega}{qoK_\Omega(\bar{\Omega}\Delta t_i + t_i\Delta\Omega)} < \frac{\bar{\Omega}}{qoK_\Omega \bar{t}_i\bar{\Omega}} \rightarrow \text{Go Lean} \quad (6)$$

Inverting and simplifying, equations 5 and 6 become:

$$\bar{\Omega}\frac{\Delta t_i}{\Delta\Omega} + \bar{t}_i < \bar{t}_i \rightarrow \text{Go Rich} \quad (7)$$

$$\bar{\Omega}\frac{\Delta t_i}{\Delta\Omega} + \bar{t}_i > \bar{t}_i \rightarrow \text{Go Lean} \quad (8)$$

Equations 7 and 8 further simplify to:

$$\frac{\Delta t_i}{\Delta\Omega} < o \rightarrow \text{Go Rich} \quad (9)$$

$$\frac{\Delta t_i}{\Delta\Omega} > o \rightarrow \text{Go Lean} \quad (10)$$

Designating fuel enriching as positive $\Delta q$ and fuel leaning as negative $\Delta q$ equations 9 and 10 can be expressed in the following Truth Table:

Truth Table

| | $\Delta t_i$ | $\Delta\Omega$ | $\Delta q$ |
|---|---|---|---|
| State 1 | + | − | + |
| State 2 | − | + | + |
| State 3 | + | + | − |
| State 4 | − | − | − |

The embodiment in FIG. 3 implements the above truth table and modulates the duration of the control pulses which operate the fuel injection system to achieve maximum fuel economy.

Referring now to FIG. 3, the function of the pulse duration modulator 45 is to provide pulses of varying duration to the fuel injectors (not shown) associated with each engine cylinder. It is, of course, understood that varying the duration of the pulses applied to the fuel injectors serves to vary the fuel flow rate to the associated internal combustion engine.

In order to vary the pulse duration, it is necessary that pulse duration modulator 45 convert an analog signal into a pulse duration. Various well known circuits can perform this function and such circuits will have the following transfer characteristic:

$$t_i = e2/Ke_1 \quad (11)$$

Parameters e1 and e2 are input signals related by suitable circuits and transducers (not shown) to engine speed, manifold vacuum, etc., parameter $t_i$ is equal to pulse duration and K is a constant. The pulse duration $t_i$ can be altered by adding or subtracting a differential signal to e2. Therefore equation 11 becomes:

$$t_i = \Delta t_i \frac{e2 + E}{Ke_1} \quad (12)$$

It is preferable to regard E as being comprised of a constant bias term and an additive or subtractive term, i.e., $E = E^o \pm \Delta$. The non-constant term accordingly provides the system disturbance described above and the optimum fuel economy seeking function. Since, as described above, the system disturbance is a change in the fuel flow rate, or $\Delta q$, equation 12 becomes:

$$t_i + \Delta t_i = \frac{e2 + E_o + \Delta q}{Ke_1} \quad 13$$

where $\Delta q$ is the change in the fuel flow rate.

The nominal, non-optimized value of $t_i$ is generated by pulse duration modulator 45 in response to input signals e2 and e1. The trigger signal shown in FIG. 3 provides the basic pulse repetition frequency at a suitable multiple of engine r.p.m. Adjustment of $t_i$ toward the optimum value is effected by summing the output signal E with input e2 to pulse duration modulator 45. Sample and hold circuits 43 and 44, along with associated flip-flop 41 and summing circuit 40, serve to introduce stepwise changes in E toward the value that corresponds to best fuel economy. The stepwise nature of the changes in E provide the disturbance that is required to ascertain the location of the operating point of the r.p.m. vs. fuel flow curve. Flip-flop 41 operates sample and hold circuits 43 and 44 in an alternating mode so that each incremental change in $\Delta q$ (change in fuel flow) is added or subtracted from the previous value of E.

More particularly, strobe generator 23 provides a fixed frequency train of strobe pulses which are applied to inverter 32, normally enabled gate 24, delay circuit 42 and gates 29 and 30. The interval between strobe pulses is defined as the sampling period for the circuit in FIG. 3. Assume, for illustrative purposes, that the circuit is in state 1 as defined in the truth table set forth above. In this state, flip-flop 31 is SET, providing a positive $\Delta q$ signal and the output of sample and hold circuit 33, $\Delta\Omega$, is negative. Sample and hold circuit 33 operates in the same manner as sample and hold circuit 15 in FIG. 1. That is, the circuit is enabled by a strobe pulse from generator 23 via inverter 32 at the beginning of a sampling period and stores the engine r.p.m. value occurring at that time. Comparator 46 than compares the stored value of engine r.p.m. with the instantaneous value of engine r.p.m. throughout the sampling period to produce the $\Delta\Omega$ signal. At this time flip-flop 41 is also in the SET state such that sample and hold circuit 43 is in the hold mode which maintains fuel control level E at the level previously set.

The negative $\Delta\Omega$ signal is directed through diode 36, inverted by polarity inverter 37, and triggers monostable multivibrator 38. The monostable fires in response to the inverted signal and provides a logical "1" signal to an input of AND gates 25 and 28 for the duration of the sampling period. A logical "1" signal is also applied to the remaining input of AND gate 25 (flip-flop 31 is SET) which is thereby enabled to apply a logical "1" signal to one input of AND gate 30. At the end of the sampling period AND gate 30 is enabled by the next strobe pulse, maintaining flip-flop 31 in the SET state, and thereby applying a positive $\Delta q$ signal to summer 40. The positive $\Delta q$ signal is therefore added to the present value of the fuel flow control signal E and the combined signal is applied to sample and hold circuits 33 and 34. After a short delay, provided by delay circuit 42, the strobe pulse causes flip-flop 41 to change state, zeroing sample and hold 43 and putting sample and hold 44 on hold, thereby storing the new, more positive value of fuel flow control signal E. The increased positive value of E is applied to pulse duration modulator 45 to increase $\Delta t_i$ in accordance with state 1 of the truth table discussed above.

If $\Delta\Omega$ is positive and $\Delta q$ is positive, the following operation occurs. The positive $\Delta\Omega$ signal triggers monostable multivibrator 39 which, in turn, applies a logical "1" signal to AND gates 26 and 28. Assuming a positive $\Delta q$ signal, AND gate 28 is enabled, AND gate 29 is enabled on the next strobe pulse, and flip-flop 31 is placed in the RESET state. This generates a negative $\Delta q$ signal which is subtracted from the current value of E by summer 40. The decreased value of E is applied to sample and hold circuits 43 and 44, flip-flop 41 changes state after a short delay and the decreased value of E is stored to become the value of E during the next sampling period in accordance with state 2 of the truth table discussed above. In response to subsequent changes in $\Delta\Omega$ and $\Delta q$ the circuitry in FIG. 3 also satisfies states 3 and 4 of the truth table in the manner just described.

The circuitry in FIG. 3 includes a lockout function for larger changes in $\Delta\Omega$ occurring during acceleration and deceleration. That is, a large value of $\Delta\Omega$ will enable threshold circuit 34 which in turn disables gate 24. This, of course, prevents additional changes in the fuel flow signal and permits the engine to operate in a conventional manner.

Although a specific embodiment of this invention has been shown and described, it will of course be understood that various modifications may be made without departing from the spirit of this invention.

In particular, the control algorithm can be implemented by a suitably programmed microprocessor.

I claim:

1. A fuel control system for an internal combustion engine, comprising: means for incrementally varying the fuel flow rate to the internal combustion engine by a predetermined amount, means for establishing a first sampling interval and for sampling and storing a first reference value of said internal combustion engine r.p.m. at the commencement of said sampling interval, means for detecting a change in said internal combustion engine r.p.m. resulting from the varying fuel flow rate, said r.p.m. change being in the range of between 10 and 20 r.p.m., means responsive to said detecting means for generating an error signal indicative of the difference in said internal combustion engine r.p.m. between internal combustion engine r.p.m. at the termination of said first sampling interval and said first reference value, and means responsive to said generating means for controlling said varying means and for changing said fuel flow rate in a second sampling interval, subsequent to said first sampling interval, in a manner which operates said internal combustion engine at a predetermined point on the engine's r.p.m. vs. fuel flow curve, said predetermined point being at the borderline of engine lean misfire, but at a predetermined displacement from misfire sufficient to provide smooth running of the engine, said first and second sampling intervals being equal and being in the range from one-fifth second to one-half second.

2. A fuel control system for an internal combustion engine comprising, means for generating a plurality of pulses, and for varying pulse duration for each of said pulses, said pulse duration controlling fuel flow rate to said internal combustion engine and said varying pulse duration incrementally varying the fuel flow rate to said internal combustion engine by a predetermined amount, means for establishing a first sampling interval and for sampling and storing a first reference value of said internal combustion engine r.p.m. at the commencement of said sampling interval, means for detecting a change in said internal combustion engine r.p.m. resulting from the varying fuel flow rate, means responsive to said detecting means for producing an error signal indicative of the difference in said internal combustion engine r.p.m. between internal combustion r.p.m. at the termination of said first sampling interval and said first reference value, and means responsive to said producing means for supplying a control signal to said generating and varying means, said control signal enabling said generating and varying means to incrementally change said pulse duration in a second sampling interval, subsequent to said first sampling interval, in a manner which operates said internal combustion engine at a predetermined point on the engine's r.p.m. vs. fuel flow curve, said predetermined point being at the borderline of engine lean misfire, but at a predetermined displacement from misfire sufficient to provide smooth running of the engine.

3. A fuel control system in accordance with claim 2, wherein said error signal can assume positive and negative values, and wherein said pulse duration is increased during said second sampling interval when said error signal is negative and said fuel flow rate is increasing during said first sampling interval.

4. A fuel control system in accordance with claim 3, wherein said pulse duration is decreased during said second sampling interval when said error signal is positive and said fuel flow rate is increasing during said first sampling interval.

5. A fuel control system in accordance with claim 4, wherein said pulse duration is increased during said second sampling interval when said error signal is positive and said fuel flow rate is decreasing during said first sampling interval.

6. A fuel control system in accordance with claim 5, wherein said pulse duration is decreased during said second sampling interval when said error signal is negative and said fuel flow rate is decreasing during said first sampling interval.

* * * * *